US007942695B1

(12) United States Patent
Lu

(10) Patent No.: US 7,942,695 B1
(45) Date of Patent: May 17, 2011

(54) CABLE END CONNECTOR

(76) Inventor: Yueh-Chiung Lu, Tao-Yuan County (TW)

( * ) Notice: Subject to any disclaimer, the term of this patent is extended or adjusted under 35 U.S.C. 154(b) by 0 days.

(21) Appl. No.: 12/889,015

(22) Filed: Sep. 23, 2010

(51) Int. Cl.
*H01R 9/05* (2006.01)

(52) U.S. Cl. ..... 439/578

(58) Field of Classification Search ..... 439/578, 439/584

See application file for complete search history.

(56) References Cited

U.S. PATENT DOCUMENTS 4,990,106 A * 2/1991 Szegda ..... 439/585
5,456,614 A * 10/1995 Szegda ..... 439/321
5,470,257 A * 11/1995 Szegda ..... 439/578
5,632,651 A * 5/1997 Szegda ..... 439/578
6,153,830 A * 11/2000 Montena ..... 439/578
6,558,194 B2 * 5/2003 Montena ..... 439/585
6,767,247 B2 * 7/2004 Rodrigues et al. ..... 439/578
7,048,579 B2 * 5/2006 Montena ..... 439/578
7,288,002 B2 * 10/2007 Rodrigues et al. ..... 439/578
7,566,236 B2 * 7/2009 Malloy et al. ..... 439/585

* cited by examiner

*Primary Examiner* — Briggitte R Hammond
(74) *Attorney, Agent, or Firm* — Muncy, Geissler, Olds & Lowe, PLLC

(57) ABSTRACT

A cable end connector includes a tubular connection member having a coupling portion, a core tube having a stop flange mounted in the coupling portion, a barbed flange and a coupling portion, a plastic outer tubular member having a front tubular coupling portion coupled to the coupling portion, a rear tubular body and an annular packing portion for engaging the coupling portion of the core tube, a retaining sleeve fastened to the rear tubular body, and an insulative holder block mounted in the core tube to hold a metal center pin for the connection of the center conductor of a coaxial cable.

12 Claims, 11 Drawing Sheets

CABLE END CONNECTOR

BACKGROUND OF THE INVENTION

1. Field of the Invention

The present invention relates electrical connectors and more particularly to a cable end connector, which comprises a tubular connection member, a core tube mounted in the tubular connection member, a plastic outer tubular member axially slidably coupled to the tubular connection member around the core tube, a retaining sleeve fastened to the around the core tube and an insulative holder block mounted in the core tube to hold a metal center pin and a metal clamp in the rear center hole of the metal center pin for quick installation of a coaxial cable without causing deformation of the center conductor of the coaxial cable or any damage to the aluminum foil shield of the coaxial cable.

2. Description of the Related Art

Following fast development of communication technology, signal transmission requires high stability and rapid speed. In consequence, different communication wire materials, from the early flat cable design to the modern round cable and optical cable designs, have been created to enhance signal transmission speed and capacity. Subject to the application of telephone technology, video technology and internet technology, global communication becomes faster and cheaper. Transmission of video signal through a cable assures signal stability and reliability. Therefore, closed-circuit TV is developed after the application of wireless TV and satellite TV. Establishing a closed-circuit television system requires installation of cables between the provider and the subscribers. When a cable is extended to the inside of a house, a cable end connector must be used to connect the cable to an indoor electric or electronic device. FIGS. 10 and 11 illustrate two similar cable end connectors according to the prior art. According to these two designs, the cable end connectors A commonly comprise a tubular connection member A1 having a connection portion A11 at the front side, an insulative holder block A12 mounted in the rear side of the tubular connection member A1, a metal center pin A13 fastened to the insulative holder block A12 and extending out of the connection portion A11 of the tubular connection member A1, an outer tubular member A2 connected to the rear side of the tubular connection member A1, a core tube A3 mounted in the outer tubular member A2 and stopped against the insulative holder block A12 and having an axial receiving chamber A30 defined therein, a barrel A4 sleeved onto the core tube A3, and a retaining sleeve A5 sleeved onto the barrel A4, and a plastic bushing A6 mounted in the retaining sleeve A5. After the cable end connector is assembled, the rear end edge A31 of the core tube A3 is kept spaced from the plastic bushing A6 and suspending in the retaining sleeve A5. When connecting the cable end connector to a coaxial cable B, the center conductor B1 of the coaxial cable B is inserted through the retaining sleeve A5, the plastic bushing A6 and the barrel A4 into the rear side of the metal center pin A13 and secured to a metal clamp A14 in the metal center pin A13, and then the retaining sleeve A5 and the plastic bushing A6 are pushed forwards to force the braided metal wrapper and outer plastic sheath of the coaxial cable B into the space in between the plastic bushing A6 and the core tube A3. In actual practice, these two prior art designs are still not satisfactory in function and have drawbacks as follows:

1. When connecting the cable end connector A and the coaxial cable B, it is necessary to insert the center conductor B1 of the coaxial cable B through the retaining sleeve A5, the plastic bushing A6 and the barrel A4 into the rear side of the metal center pin A13 to have the center conductor B1 be secured to the metal clamp A14 in the metal center pin A13. However, because the operator cannot see the position of the metal clamp A14 in the cable end connector when inserting the center conductor B1 of the coaxial cable B into the cable end connector, the center conductor B1 may be not accurately inserted into the rear side of the metal center pin A13, causing a contact error or signal transmission instability.
2. When connecting the cable end connector A and the coaxial cable B, the inner dielectric insulator B2 and aluminum foil shield B3 of the coaxial cable B are inserted through the retaining sleeve A5 and the plastic bushing A6 into the barrel A4 and then the receiving chamber A30 of the core tube A3. However, because the operator cannot visually check the alignment during insertion, the aluminum foil shield B3 of the coaxial cable B may be damaged accidentally, affecting signal transmission stability and reliability.

Therefore, it is desirable to provide a cable end connector, which facilitates quick and accurate connection of a coaxial cable without causing deformation of the center conductor of the coaxial cable or damage to the aluminum foil shield of the coaxial cable.

SUMMARY OF THE INVENTION

The present invention has been accomplished under the circumstances in view. It is the main object of the present invention to provide a cable end connector, which facilitates quick and accurate installation of a coaxial cable to assure signal transmission quality and reliability without causing deformation of the center conductor of the coaxial cable or any damage to the aluminum foil shield of the coaxial cable To achieve this and other objects of the present invention, a cable end connector comprises a tubular connection member, a core tube, a plastic outer tubular member, a retaining sleeve, an insulative holder block and a metal center pin. The tubular connection member comprises an axial hole defined therein and extending through opposing front and rear sides thereof and a coupling portion located on a rear side around the axial hole thereof. The core tube comprises a receiving chamber defined therein and extending through opposing front and rear sides thereof, a stop flange outwardly protruded from the periphery of the front side thereof and mounted in the coupling portion of the tubular connection member, a barbed flange located on the rear side thereof, a coupling portion spaced between the stop flange and the barbed flange. The plastic outer tubular member comprises a front tubular coupling portion coupled to the coupling portion of the tubular connection member, a rear tubular body, an accommodation chamber axially extending through the front tubular coupling portion and the rear tubular boy, and an annular packing portion inwardly protruded from an inside wall of the front tubular coupling portion and suspending in the accommodation chamber for engaging the coupling portion of the core tube. The retaining sleeve is fastened to the rear tubular body of the plastic outer tubular member, comprising a sleeve chamber defined therein for receiving the plastic outer tubular member, a tapered insertion hole located on a rear side thereof in communication with the sleeve chamber for the insertion of a coaxial cable and a shoulder protruded from an inside wall thereof adjacent to the insertion hole for stopping the plastic outer tubular member in place. After insertion of a coaxial cable into the tapered insertion hole of the retaining sleeve, the braided metal wrapper and outer plastic sheath of the coaxial cable are secured to the accommodation chamber in between the plastic outer tubular member and the core tube, the barbed flange of the core tube is engaged into the braided metal wrapper of the coaxial cable, the shoulder of the retaining sleeve is pressed on the periphery of the outer plastic sheath of the coaxial cable, and therefore, the braided metal wrapper and outer plastic sheath of the coaxial cable are firmly secured in place inside the plastic outer tubular member and the retaining sleeve and between the plastic outer tubular member and the core tube and the center conductor of the coaxial cable is electrically connected to a metal center pin in the core tube for signal transmission.

Further, the tubular connection member comprises a plurality of longitudinal crevices cut through said connection portion thereof, and a hollow sliding shell axially slidably coupled to the connection portion. The hollow sliding shell comprises a sliding hole axially forwardly extending to the front side thereof and adapted for receiving the connection portion of the tubular connection member, a receiving chamber axially backwardly extending from the sliding hole to the rear side thereof, and a locating groove extending around the inside wall thereof in the receiving chamber. The tubular connection member further comprises a snap ring fixedly fastened to the periphery of the connection portion, an insulative washer mounted on the connection portion and stopped against the front side of the snap ring, a metal washer sleeved onto the connection portion and fastened to the locating groove of the hollow sliding shell for axial movement with the hollow sliding shell along the connection portion and an elastic member mounted around the connection portion and stopped between the snap ring and the metal washer.

In one embodiment of the present invention, the cable end connector further comprises an insulative holder block mounted in the axial hole of the tubular connection member to hold the metal center pin. According to this embodiment, the insulative holder block comprises a rear abutment face located on a rear side thereof and abutted against the stop flange of the core tube, a front mounting hole located on a front side thereof and a rear guide hole located on the rear abutment face in communication with the front mounting hole. Further, the metal center pin comprises a rear mounting base press-fitted into the front mounting hole of the insulative holder block, a front pin head axially forwardly extended from the rear mounting base and suspending outside the insulative holder block, a rear center hole formed in the rear mounting base and axially extending to a rear side of the rear mounting base remote from the front pin head and a metal clamp mounted in the rear center hole. Further, the metal clamp comprises a plurality of metal clamp pawls equiangularly spaced around the periphery of the rear center hole and obliquely forwardly extending in direction toward the central axis of the rear center hole.

In another embodiment of the present invention, the cable end connector further comprises an insulative holder block mounted in the receiving chamber of the core tube to hold the metal center pin. The insulative holder block comprises a rear abutment face located on a rear side thereof and facing the insertion hole of the retaining sleeve, a front mounting hole located on a front side thereof and a rear guide hole located on the rear abutment face in communication with the front mounting hole. Further, the metal center pin comprises a rear mounting base press-fitted into the front mounting hole of the insulative holder block, a front pin head axially forwardly extended from the rear mounting base and suspending outside the insulative holder block, a rear center hole formed in the rear mounting base and axially extending to a rear side of the rear mounting base remote from the front pin head and a metal clamp mounted in the rear center hole. The metal clamp comprises a plurality of metal clamp pawls equiangularly spaced around the periphery of the rear center hole and obliquely forwardly extending in direction toward the central axis of the rear center hole.

DETAILED DESCRIPTION OF THE PREFERRED EMBODIMENT

Figure 1:
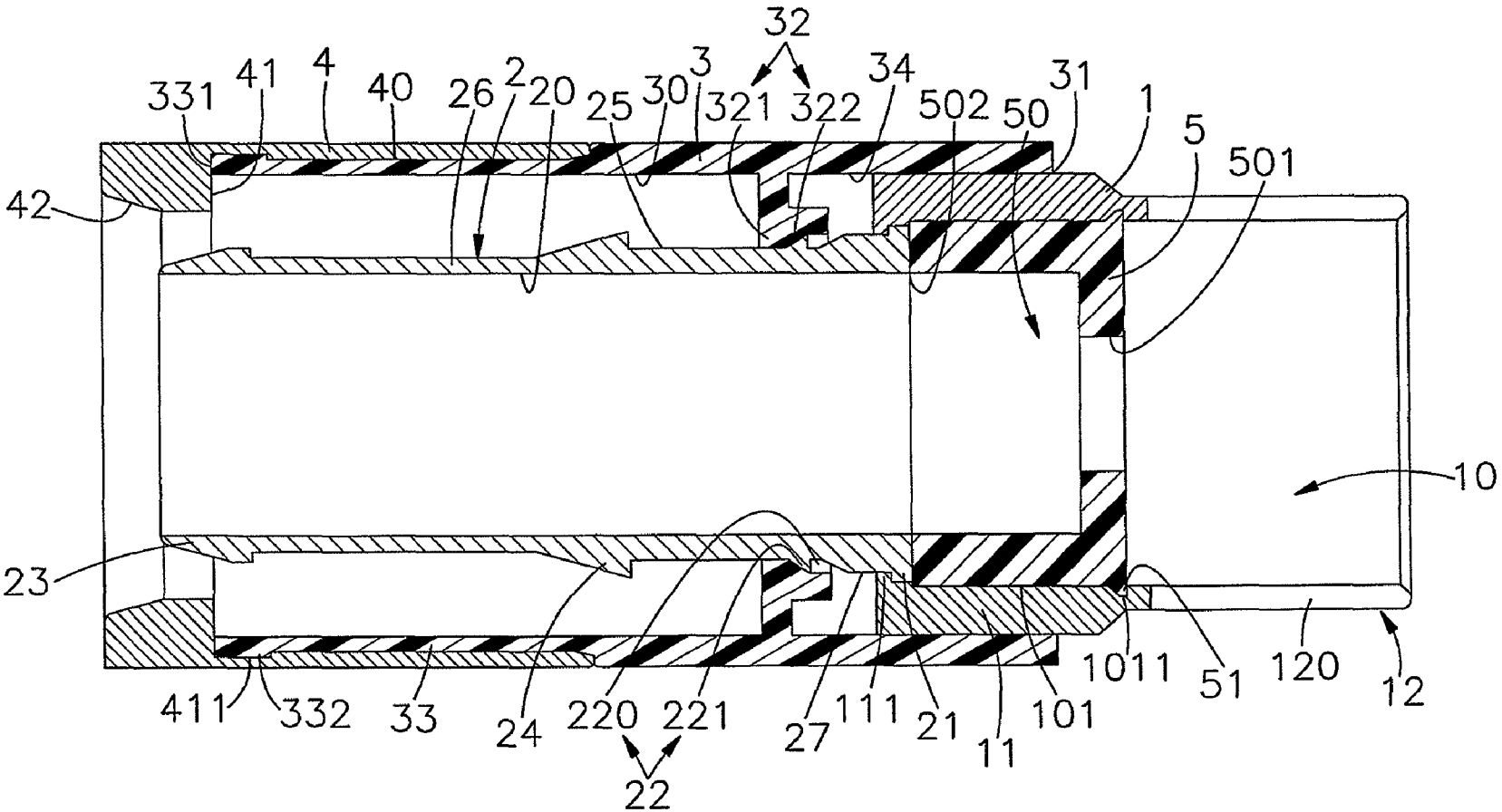
FIG. 1 is a sectional side view of a cable end connector in accordance with one embodiment of the present invention (the insulative holder block and the metal center pin excluded).
Figure 2:
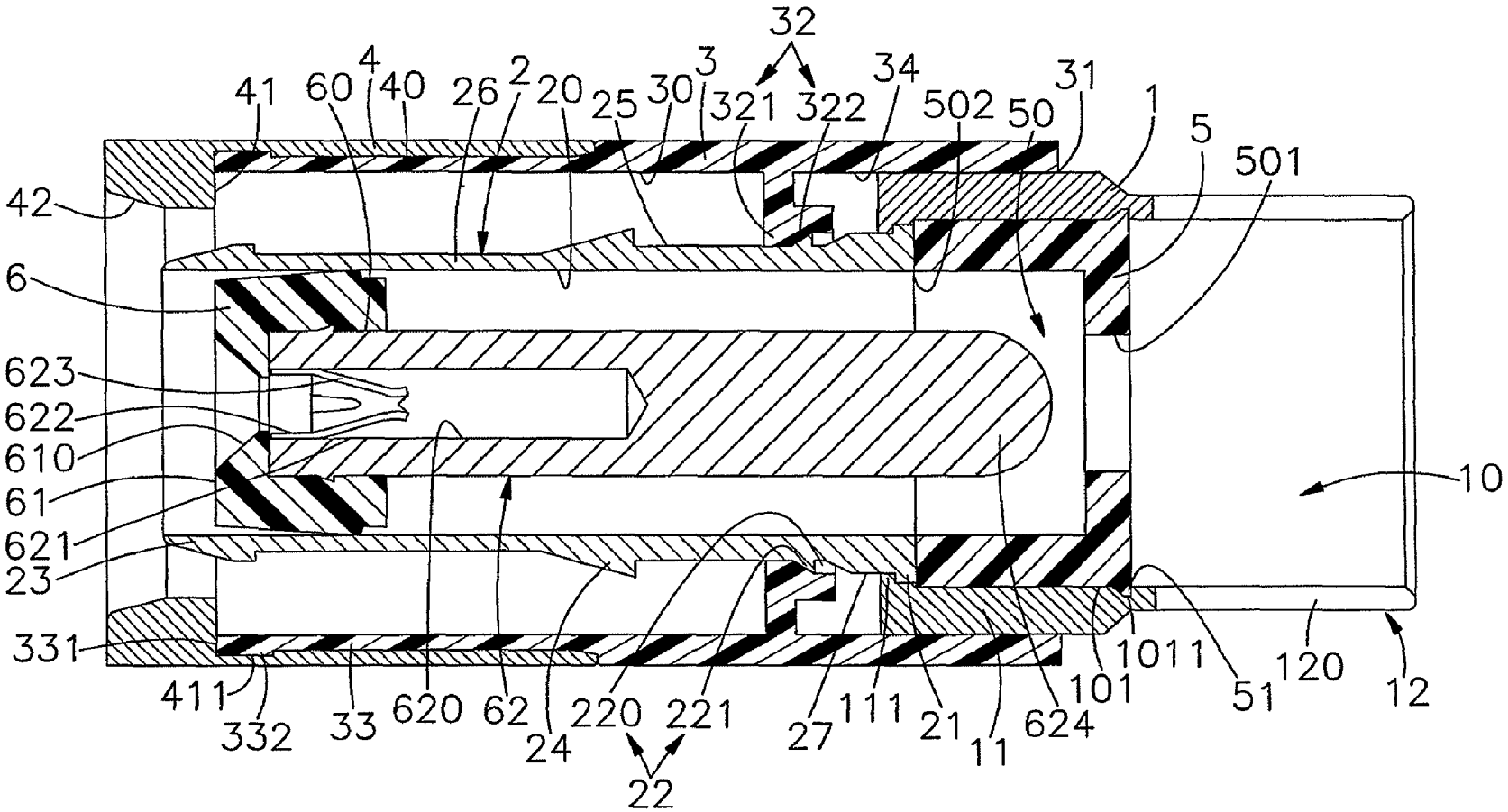
FIG. 2 is a sectional side view of a cable end connector in accordance with one embodiment of the present invention (the insulative holder block and the metal center pin installed).
Figure 3:
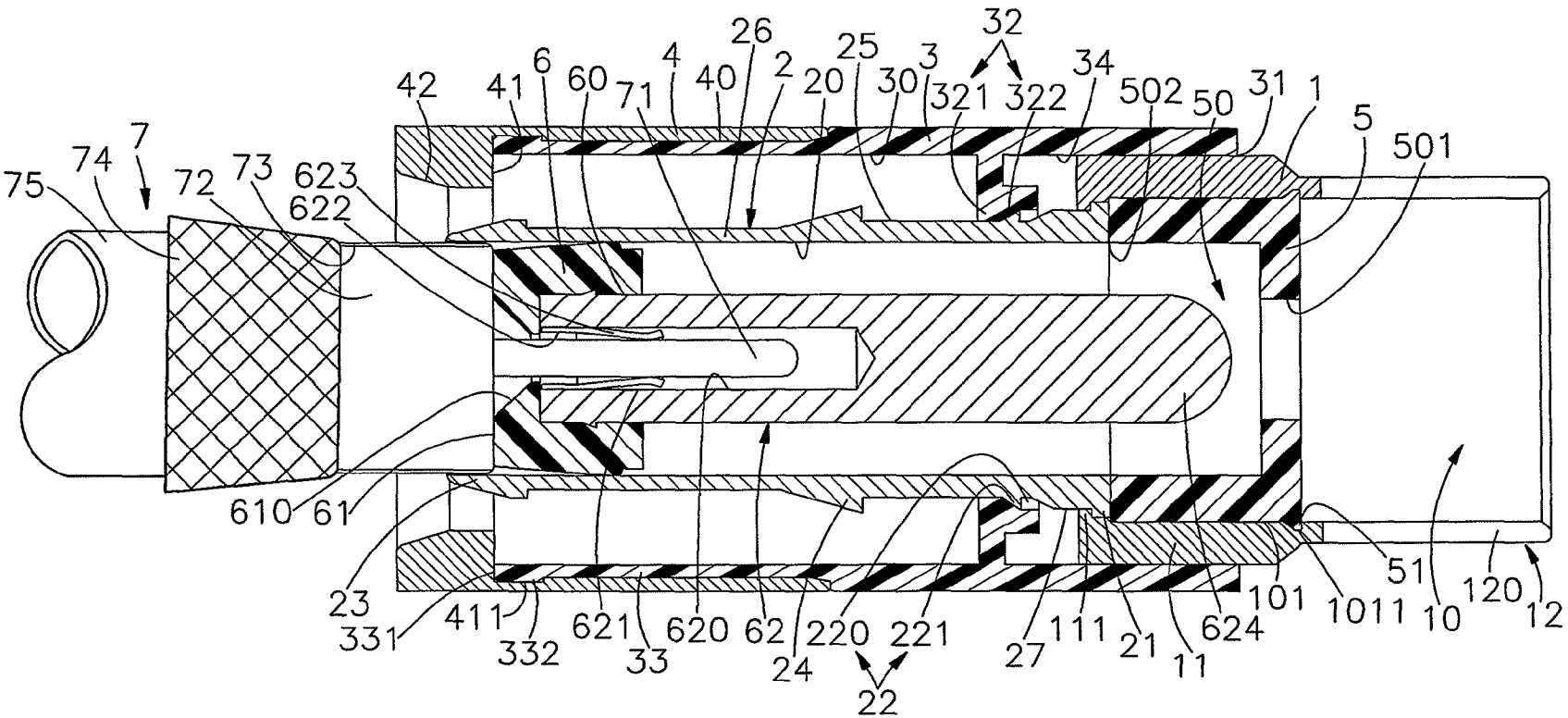
FIG. 3 is an installed view in section of the present invention, showing a coaxial cable inserted into the cable end connector.

Referring to FIGS. 1~3, a cable end connector in accordance with the present invention is shown comprising a tubular connection member 1, a core tube 2, a plastic outer tubular member 3 and a retaining sleeve 4.

The tubular connection member 1 comprises an axial hole 10 defined therein and extending through opposing front and rear sides thereof, a coupling portion 11 located on the rear side around the axial hole 10 and an annular retaining rim 111 inwardly protruded from the distal end of the coupling portion 11.

The core tube 2 comprises a receiving chamber 20 defined therein and extending through opposing front and rear sides thereof, a stop flange 21 outwardly protruded from the periphery of the front side thereof, a barbed flange 23 located on the rear side thereof, a first tubular wall 25 and a second tubular wall 26 axially connected in series between the stop flange 21 and the barbed flange 23, a hooked portion 24 extending around the periphery between the first tubular wall 25 and the second tubular wall 26, a coupling portion 22 connected between the second tubular wall 26 and the stop flange 21 and an engagement portion 27 connected between the coupling portion 22 and the stop flange 21.

The plastic outer tubular member 3 comprises a front tubular coupling portion 31, a rear tubular body 33 that has an outer diameter relatively smaller than the front tubular coupling portion 31, an accommodation chamber 30 axially extending through the front tubular coupling portion 31 and the rear tubular boy 33, an annular packing portion 32 inwardly protruded from the inside wall of the front tubular coupling portion 31 and suspending in the accommodation chamber 30, a coupling space 34 defined in the accommodation chamber 30 within the front tubular coupling portion 31, a rear end edge 331 located on the distal end of the rear tubular body 33 remote from the front tubular coupling portion 31, and a retaining flange 332 extending around the periphery of the rear end edge 331.

The retaining sleeve 4 comprises a sleeve chamber 40 defined therein, an insertion hole 42 located on one end thereof in communication with the sleeve chamber 40, a shoulder 41 protruded from the inside wall thereof adjacent to the insertion hole 42 and a retaining groove 411 located on the inside wall thereof and abutted to the shoulder 41. Further, the insertion hole 42 is a tapered hole having a diameter gradually reducing indirection toward the inside of the sleeve chamber 40.

When assembling the cable end connector, insert the core tube 2 into the axial hole 10 of the tubular connection member 1 to force the stop flange 21 of the core tube 2 into engagement with the annular retaining rim 111 of the coupling portion 11 of the tubular connection member 1, and then insert the core tube 2 into the accommodation chamber 30 of the plastic outer tubular member 3 to force the coupling portion 22 of the core tube 2 into engagement with the annular packing portion 32 of the plastic outer tubular member 3. According to the this embodiment, the outer diameter of the coupling portion 22 of the core tube 2 is greater than the inner diameter of the annular packing portion 32, therefore the core tube 2 is firmly secured to the plastic outer tubular member 3 after insertion of the core tube 2 into the plastic outer tubular member 3 to engage the coupling portion 22 into, the annular packing portion 32. Thereafter, insert the rear tubular body 33 of the plastic outer tubular member 3 into the sleeve chamber 40 of the retaining sleeve 4 to stop the shoulder 41 of the retaining sleeve 4 against the rear end edge 331 of the rear tubular body 33 of the plastic outer tubular member 3 and to force retaining flange 332 of the plastic outer tubular member 3 into engagement with the retaining groove 411 of the retaining sleeve 4. Thus, the tubular connection member 1, the core tube 2, the plastic outer tubular member 3 and the retaining sleeve 4 are assembled together, forming the desired cable end connector. Further, the insertion hole 42 of the retaining sleeve 4 is a tapered hole having a diameter gradually reducing in direction toward the barbed flange 23 of the core tube 2.

Further, the engagement portion 27 of the core tube 2 carries an embossed pattern (not shown) consisting of, for example, a plurality of raised portions for engagement with the packing portion 32 of the plastic outer tubular member 3 to secure the core tube 2 to the plastic outer tubular member 3 in the accommodation chamber 30 firmly. By means of changing the contact area between the coupling portion 22 of the core tube 2 and the packing portion 32 of the plastic outer tubular member 3, the connection tightness between the core tube 2 and the plastic outer tubular member 3 is relatively controlled. When inserting a cable 7 into the receiving chamber 20 of the core tube 2 (see also FIG. 5), a thrust force can be produced to push the coupling portion 22 away from the packing portion 32, allowing the first tubular wall 25 to be moved axially relative to the packing portion 32.

Further, the cable end connector of the invention consists of a small number of component parts, i.e., the tubular connection member 1, the core tube 2, the plastic outer tubular member 3 and the retaining sleeve 4, and therefore the installation of the cable end connector is easy, requiring less labor and time.

The tubular connection member 1 further comprises a connection portion 12 located on the front side around the axial hole 10, a plurality of longitudinal crevices 120 cut through the connection portion 12 (the longitudinal crevices 120 may be eliminated), a positioning groove 101 located on the inside wall of the coupling portion 11 inside the axial hole 10 and a retaining groove 1011 disposed in the positioning groove 101 around the inside wall of the coupling portion 11 and adjacent to the connection portion 12. Further, a stop member 5 is mounted in the positioning groove 101 inside the tubular connection member 1 and stopped against the stop flange 21 of the core tube 2. The stop member 5 comprises a retaining rim 51 extending around of the periphery of one side, namely, the front side thereof and engaged into the retaining groove 1011 of the tubular connection member 1, an inside chamber 50 defined therein, a through hole 501 located on the front side in communication with the inside chamber 50, an opening 502 located on an opposite side, namely, the rear side thereof and kept in communication between the inside chamber 50 and the receiving chamber 20 of the core tube 2. The through hole 501 has a diameter smaller than the inside chamber 50. Further, an insulative holder block 6 is mounted in the rear side of the core tube 2 inside the receiving chamber 20 to hold a metal center pin 62. The insulative holder block 6 comprises a rear abutment face 61 located on the rear side thereof and facing the insertion hole 42 of the retaining sleeve 4, a front mounting hole 60 located on the front side thereof, a rear guide hole 610 located on the rear abutment face 61 in communication with the front mounting hole 60. The metal center pin 62 is made of copper, aluminum, nickel or their alloy, comprising a rear mounting base 621 press-fitted into the front mounting hole 60 of the insulative holder block 6, a front pin head 624 axially forwardly extended from the rear mounting base 621 and suspending in the receiving chamber 20 of the core tube 2 outside the insulative holder block 6, a rear center hole 620 formed in the rear mounting base 621 and axially extending to the rear side of the rear mounting base 621 remote from the front pin head 624, and a metal clamp 622 mounted in the rear center hole 620. The metal clamp 622 comprises a plurality of metal clamp pawls 623 equiangularly spaced around the periphery of the rear center hole 620 and obliquely forwardly extending in direction toward the central axis of the rear center hole 620.

Figure 4:
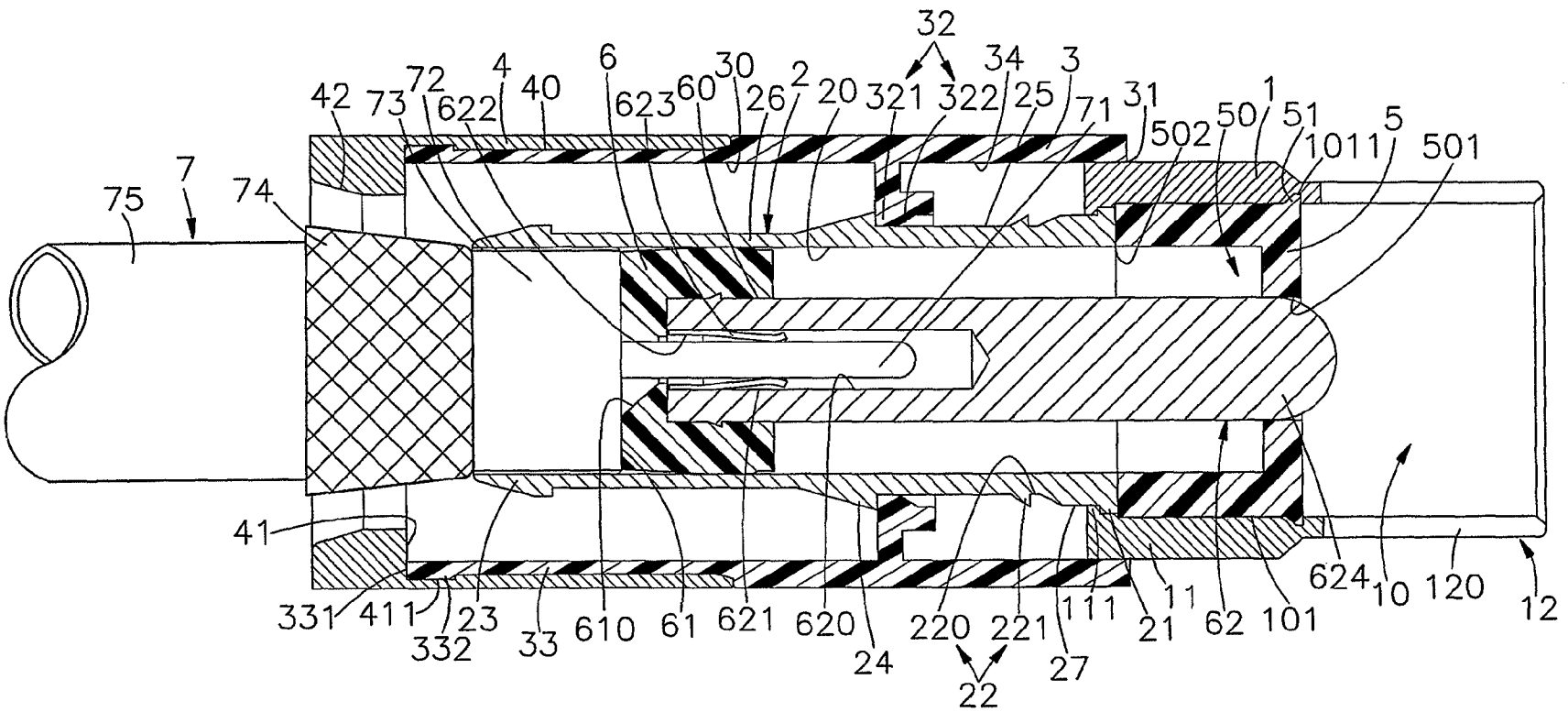
FIG. 4 corresponds to FIG. 3, showing the coaxial cable pushed forwards, the annular packing portion of the plastic outer tubular member stopped at the hooked portion of the core tube.
Figure 5:
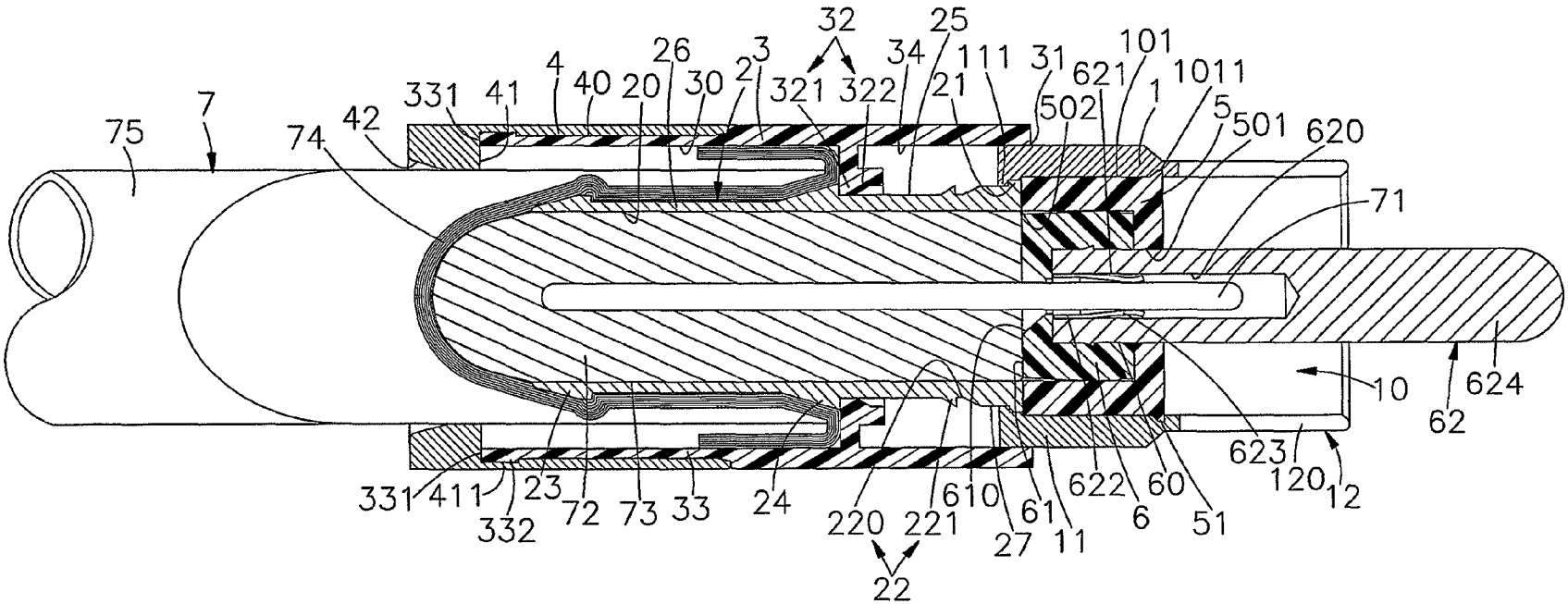
FIG. 5 corresponds to FIG. 4, showing the coaxial cable fastened to the core tube and the plastic outer tubular member and electrically connected to the metal center pin and the tubular connection member extended out of the plastic outer tubular member.
Figure 6:
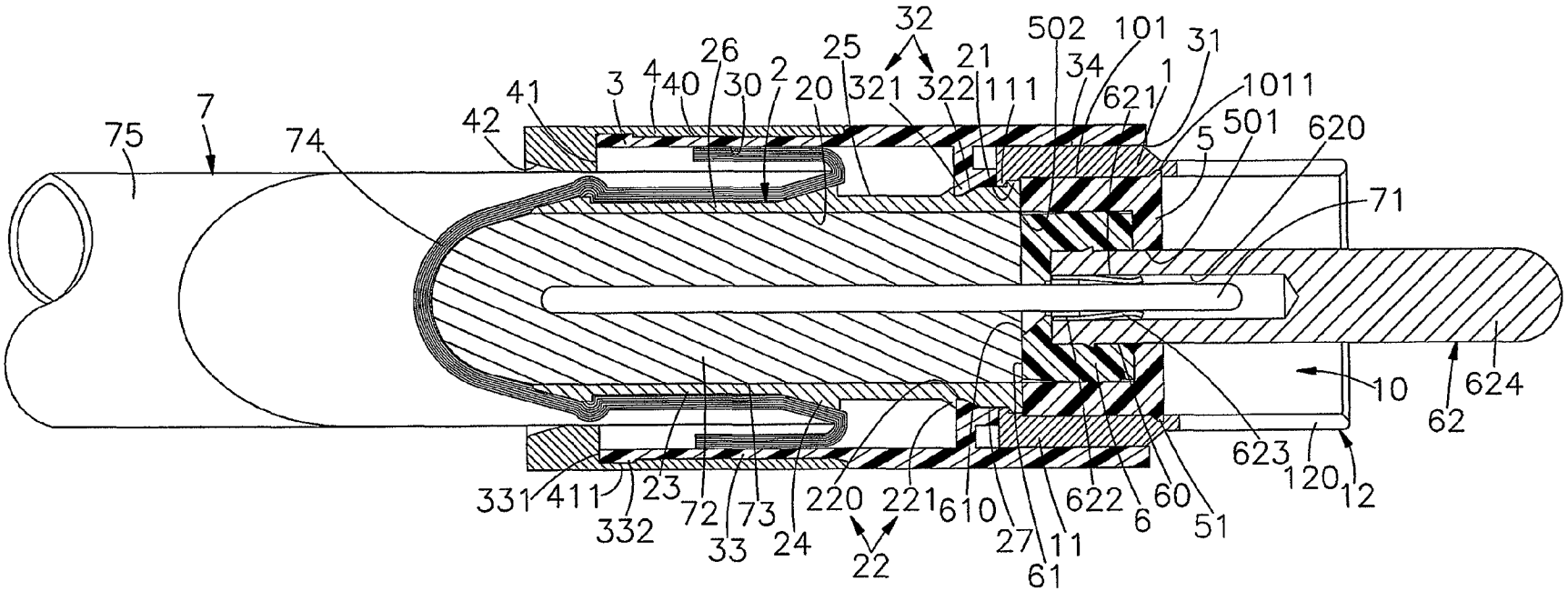
FIG. 6 corresponds to FIG. 5, showing the tubular connection member pushed back into the inside of the plastic outer tubular member and stopped against the annular packing portion.

Referring to FIGS. 4-6 and FIG. 3 again, the cable end connector of the present invention is to be fastened to one end of a coaxial cable 7 comprising an outer plastic sheath 75, a braided metal wrapper 74 surrounded by the outer plastic sheath 75, an aluminum foil shield 73 surrounded by the braided metal wrapper 74, an inner dielectric insulator 72 surrounded by the aluminum foil shield 73 and a center conductor 71 surrounded by the inner dielectric insulator 72. During installation, insert the center conductor 71 of the coaxial cable 7 through the insertion hole 42 of the retaining sleeve 4 and the rear guide hole 610 of the insulative holder block 6 into the metal clamp 622 in the rear center hole 620 of the metal center pin 62, enabling the center conductor 71 to be clamped by the clamp pawls 623 of the metal clamp 622 and electrically connected to the metal center pin 62 and the end edge of the inner dielectric insulator 72 of the coaxial cable 7 to be stopped against the rear abutment face 61 of the insulative holder block 6. When continuously forwardly push the coaxial cable 7 in direction from the receiving chamber 20 of the core tube 2 toward the inside chamber 50 of the stop member 5 at this time, the core tube 2 will be moved by the coaxial cable 7 to disengage its coupling portion 22 from the annular packing portion 32 of the plastic outer tubular member 3 and to force its stop flange 21 against the stop member 5 and the tubular connection member 1, moving the stop member 5 and the tubular connection member 1 toward the outside of the front tubular coupling portion 31 of the plastic outer tubular member 3. Therefore, the coaxial cable 7 can be continuously pushed forwards to move the insulative holder block 6 out of the receiving chamber 20 of the core tube 2 through the opening 50 into the inside chamber 50 of the stop member 5 to carry the metal center pin 62 to the position where the front pin head 624 extends out of the through hole 501 of the stop member 5 into the axial hole 10 of the tubular connection member 1. At this time, the inner dielectric insulator 72 and aluminum foil shield 73 of the coaxial cable 7 are inserted into the receiving chamber 20 of the core tube 2; the braided metal wrapper 74 and a part of the outer plastic sheath 75 of the coaxial cable 7 are inserted into the accommodation chamber 30 of the plastic outer tubular member 3; the barbed flange 23 of the core tube 2 is engaged into the braided metal wrapper 74 of the coaxial cable 7; the shoulder 41 of the retaining sleeve 4 is pressed on the periphery of the outer plastic sheath 75 of the coaxial cable 7. Therefore, the braided metal wrapper 74 and outer plastic sheath 75 of the coaxial cable 7 are firmly secured in place inside the plastic outer tubular member 3 and the retaining sleeve 4 and between the plastic outer tubular member 3 and the core tube 2. Thereafter, move the front tubular coupling portion 31 of the plastic outer tubular member 3 toward the coupling portion 11 of the tubular connection member 1 to force the annular packing portion 32 of the plastic outer tubular member 3 into engagement with the coupling portion 22 of the core tube 2 firmly. Thus, the coaxial cable 7 and the cable end connector are tightly fastened together and electrically connected together, allowing connection of the connection portion 12 of the tubular connection member 1 to an external mating electric connector (not shown) for signal transmission through the coaxial cable 7 and the metal center pin 62 to the connected external mating electric connector.

Further, the coupling portion 22 of the core tube 2 of the cable end connector comprises a coupling groove 220 and a coupling rib 221 extending around the periphery in a parallel manner and abutted against each other; the annular packing portion 32 of the plastic outer tubular member 3 comprises a packing rib 321 suspending in the accommodation chamber 30 and a beveled face 322 located on one side of the packing rib 321. Before connection of the cable end connector to the coaxial cable 7, the beveled face 322 of the plastic outer tubular member 3 is stopped at an outer side of the coupling rib 221. When forcing the front tubular coupling portion 31 of the plastic outer tubular member 3 into engagement with the coupling portion 11 of the tubular connection member 1 the beveled face 322 of the plastic outer tubular member 3 will be moved over the coupling rib 221 of the coupling portion 22 of the core tube 2, and the packing rib 321 will be forced into engagement with the coupling groove 220 of the coupling portion 22 of the core tube 2 and stopped in position by the coupling rib 221. Subject to the design that the outer diameter of the coupling portion 22 of the core tube 2 is slightly greater than the inner diameter of the annular packing portion 32 of the plastic outer tubular member 3, the outer tubular member 3 is firmly secured to the core tube 2 on the outside.

Figure 7:
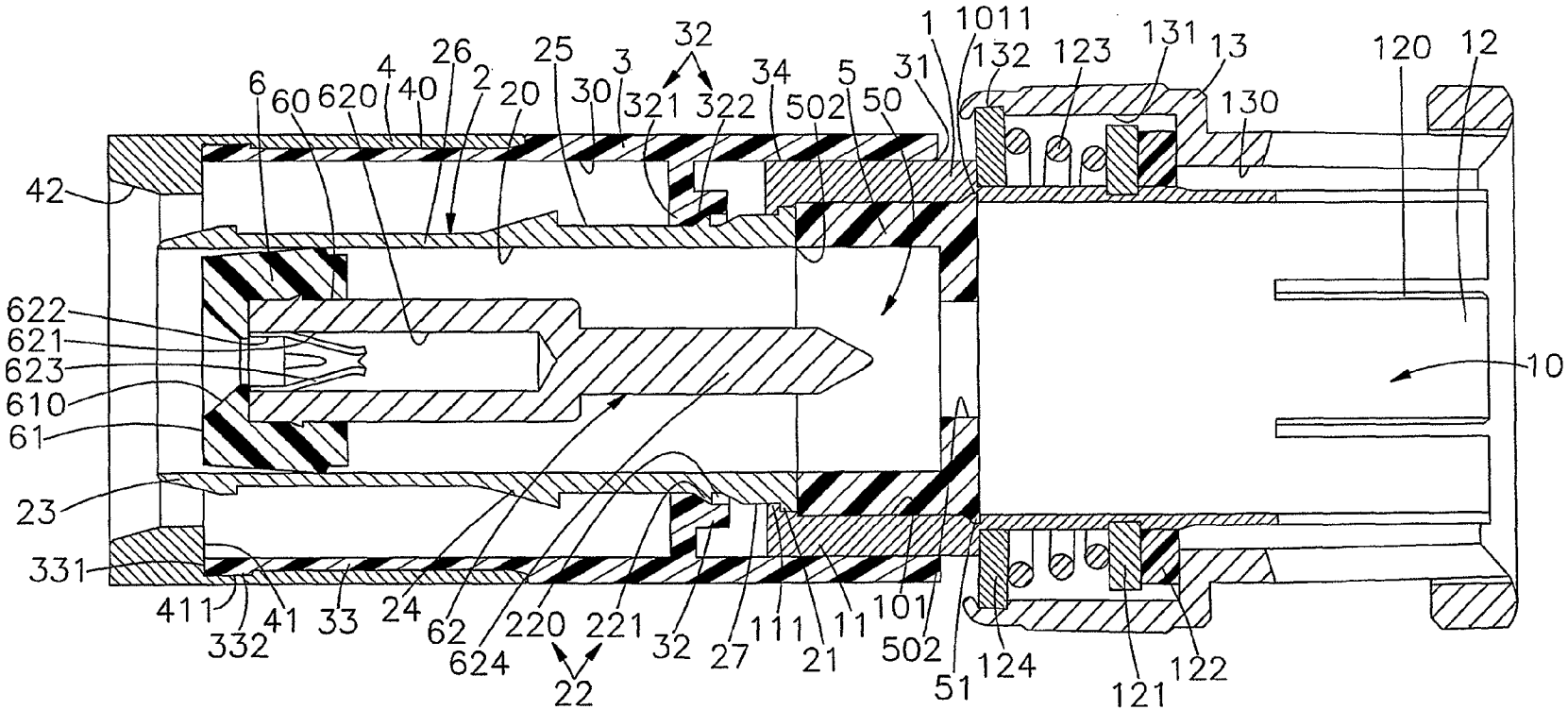
FIG. 7 is a sectional view of an alternate form of the cable end connector in accordance with the present invention.

FIG. 7 illustrates an alternate form of the cable end connector according to the present invention. According to this alternate form, a hollow sliding shell 13 is axially slidably coupled to the connection portion 12 of the tubular connection member 1. The hollow sliding shell 13 comprises a sliding hole 130 axially forwardly extending to the front side thereof and adapted for receiving the connection portion 12 of the tubular connection member 1 corresponding to the longitudinal crevices 120, a receiving chamber 131 axially backwardly extending from the sliding hole 130 to the rear side thereof, and a locating groove 132 extending around the inside wall thereof in the receiving chamber 131. Further, a snap ring 121 is fixedly fastened to the periphery of the connection portion 12 of the tubular connection member 1 away from the longitudinal crevices 120; an insulative washer 122 is mounted on the connection portion 12 of the tubular connection member 1 and stopped against the front side of the snap ring 121; a metal washer 124 is sleeved onto the connection portion 12 of the tubular connection member 1 and fastened to the locating groove 132 of the hollow sliding shell 13 for axial movement with the hollow sliding shell 13 along the connection portion 12 of the tubular connection member 1; an elastic member, for example, compression spring 123 mounted around the connection portion 12 of the tubular connection member 1 and stopped between the snap ring 121 and the metal washer 124 to impart a pressure to the metal washer 124 in direction away from the snap ring 121.

Figure 8:
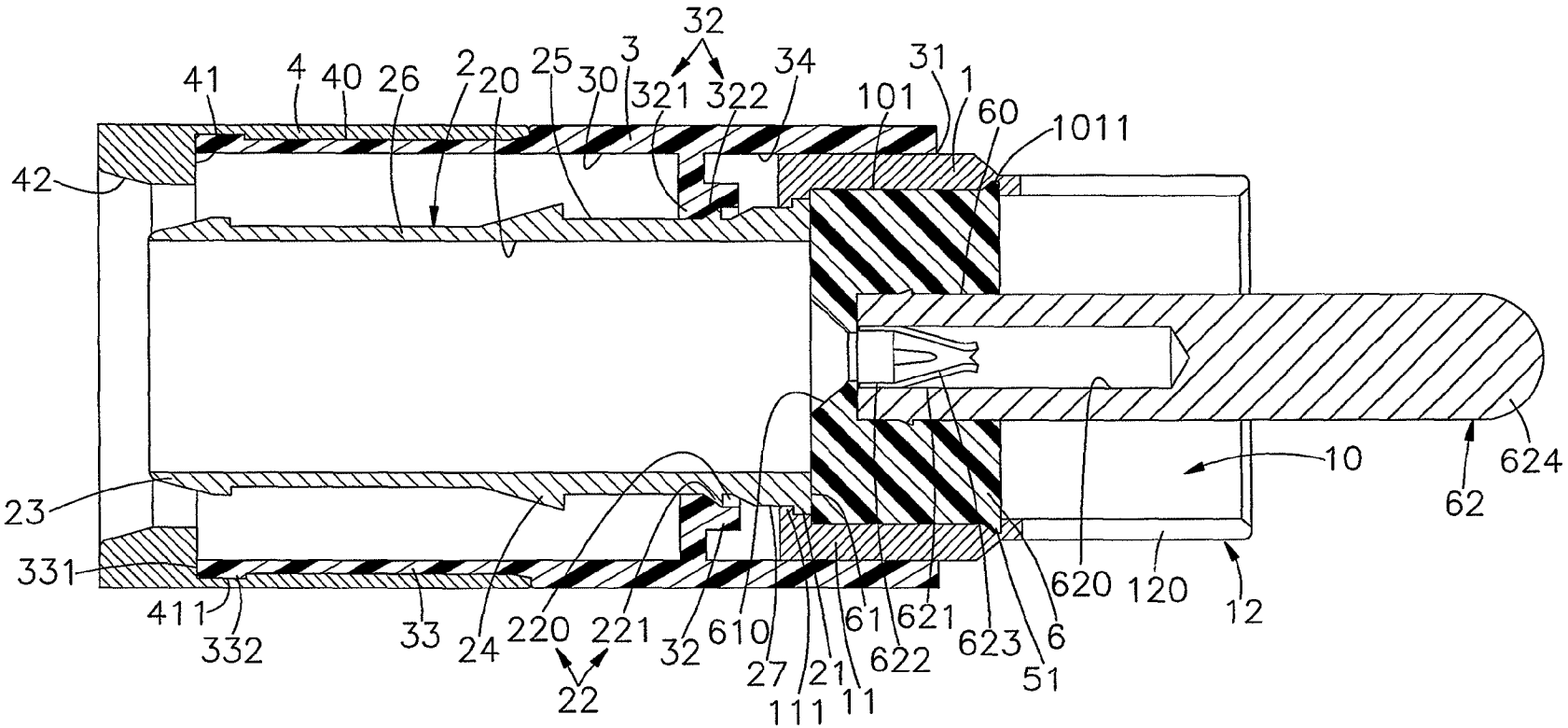
FIG. 8 is a sectional view of another alternate form of the cable end connector in accordance with the present invention.

FIG. 8 illustrates another alternate form of the cable end connector according to the present invention. According to this embodiment, an insulative holder block 6 is mounted in the positioning groove 101 of the tubular connection member 1 and stopped against the core tube 2 to hold a metal center pin 62 in axial alignment with the insulative holder block 6. The insulative holder block 6 comprises a retaining rim 63 engaged into the retaining groove 1011 a rear abutment face 61 located on the rear side thereof and stopped against the stop flange 21 of the core tube 2, a front mounting hole 60 located on the front side thereof, a rear guide hole 610 located on the rear abutment face 61 in communication between the front mounting hole 60 and the receiving chamber 20 of the core tube 2. The metal center pin 62 comprises a rear mounting base 621 press-fitted into the front mounting hole 60 of the insulative holder block 6, a front pin head 624 axially forwardly extended from the rear mounting base 621 and suspending outside the connection portion 12 of the tubular connection member 1, a rear center hole 620 formed in the rear mounting base 621 and axially extending to the rear side of the rear mounting base 621 remote from the front pin head 624, and a metal clamp 622 mounted in the rear center hole 620. The metal clamp 622 comprises a plurality of metal clamp pawls 623 equiangularly spaced around the periphery of the rear center hole 620 and obliquely forwardly extending in direction toward the central axis of the rear center hole 620.

Figure 9:
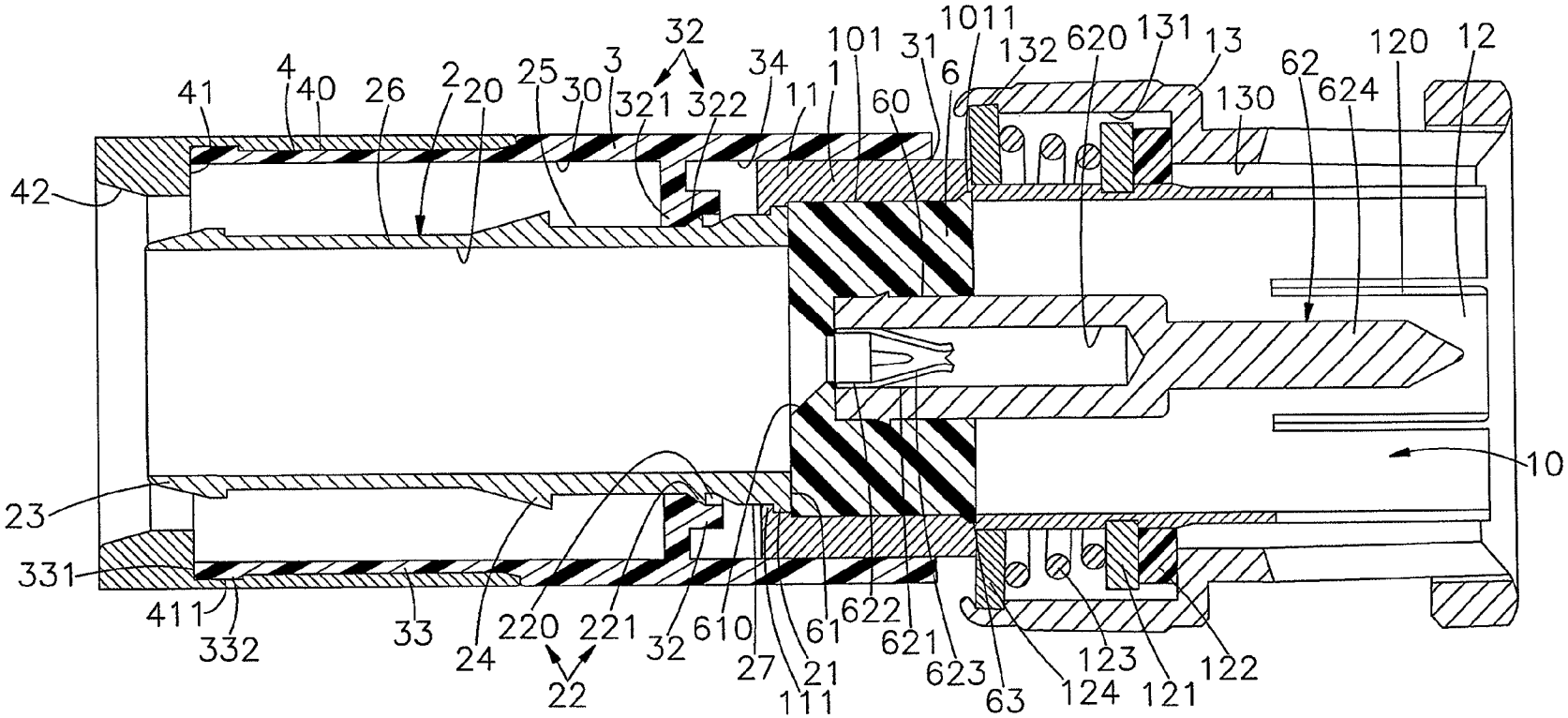
FIG. 9 is a sectional view of still another alternate form of the cable end connector in accordance with the present invention.
Figure 10:
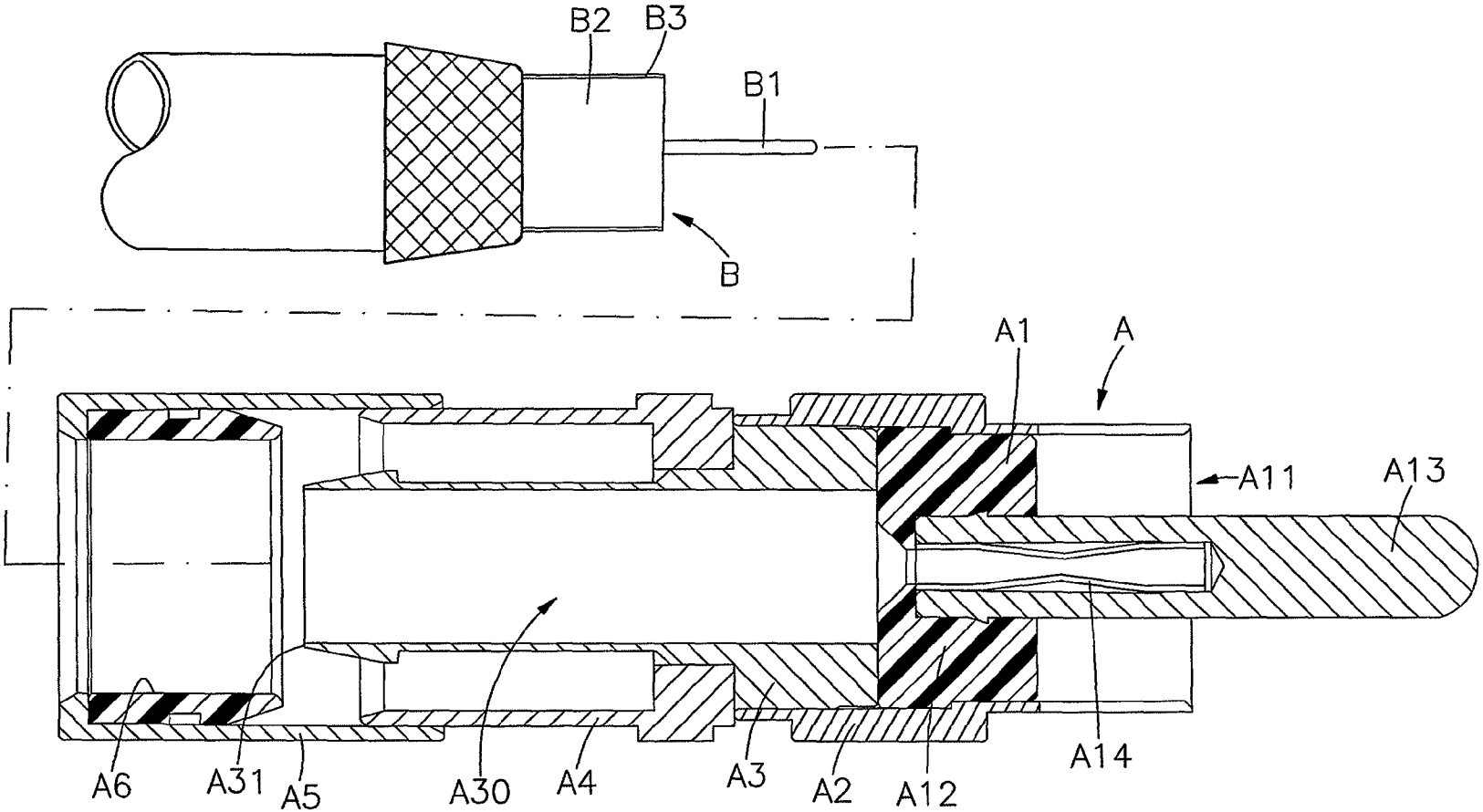
PRIOR ART FIG. 10
FIG. 10 is a sectional view of a cable end connector according to the prior art.
Figure 11:
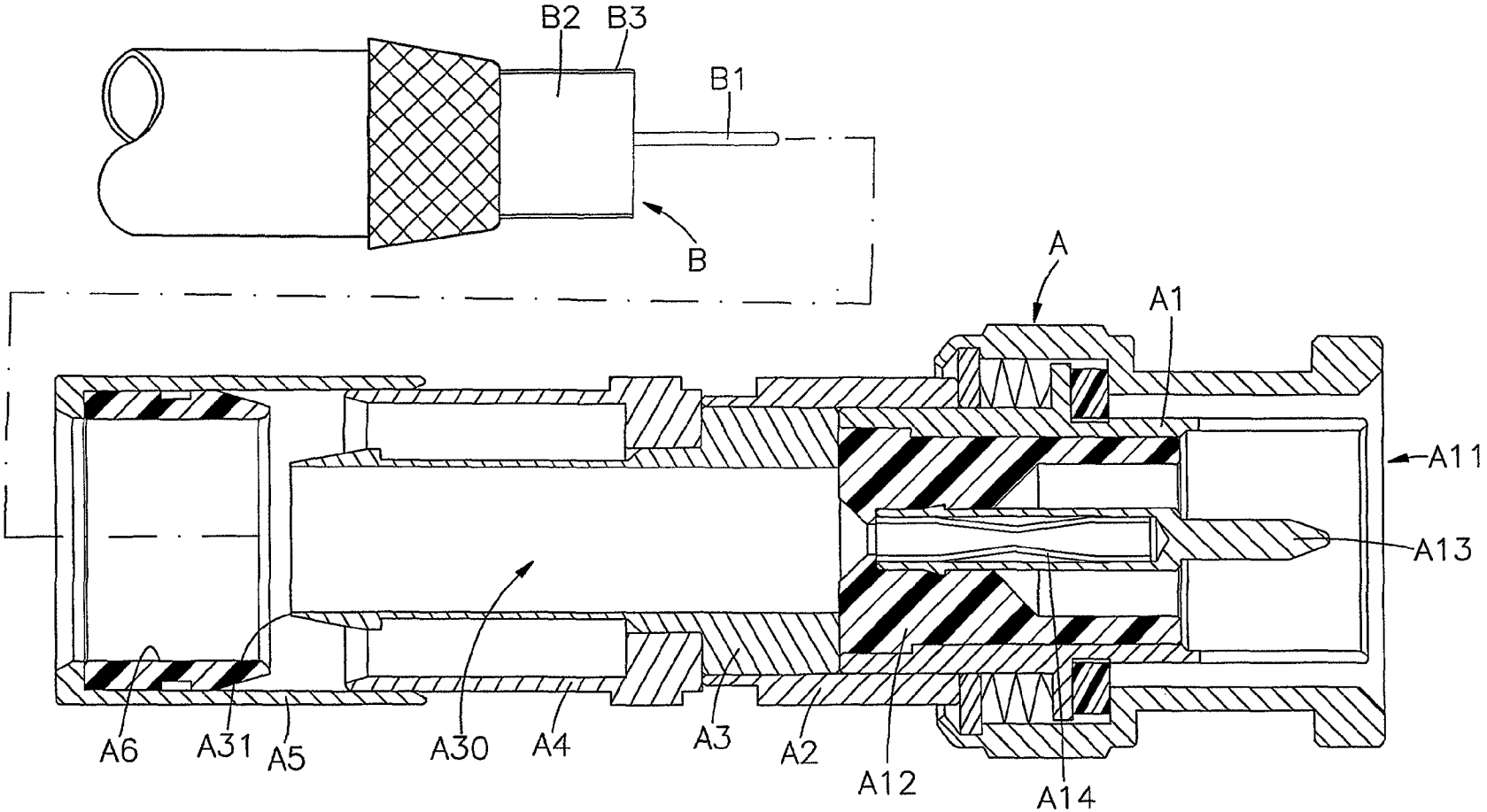
PRIOR ART FIG.11
FIG. 11 is a sectional view of another structure of cable end connector according to the prior art.

FIG. 9 illustrates still another alternate form of the cable end connector according to the present invention. This embodiment is based on the embodiment shown in FIG. 8 with the added hollow sliding shell 13 that is axially slidably coupled to the connection portion 12 of the tubular connection member 1 in the same manner as that shown in FIG. 7.

It is to be understood that the above described embodiments are simply exemplars of the invention and not intended as limitations of the invention. According the above described embodiments, the stop flange 21 of the core tube 2 is mounted in the coupling portion 11 of the tubular connection member 1; the front tubular coupling portion 31 of the plastic outer tubular member 3 is coupled to the coupling portion 11 of the tubular connection member 1 and surrounded by the retaining sleeve 4 to force the annular packing portion 32 into engagement with the coupling portion 22 of the core tube 2; the insulative holder block 6 is mounted in the receiving chamber 20 inside the core tube 2 to hold the metal center pin 62 in axial alignment with the central axis of the core tube 2 with the rear abutment face 61 thereof facing the insertion hole 42 of the retaining sleeve 4 for easy insertion of the coaxial cable 7 so that the center conductor 71 of the coaxial cable 7 can be easily and accurately inserted into and electrically connected to the metal center pin 62 for signal transmission to a mating electric connector to which the connection portion 12 of the tubular connection member 1 or the hollow sliding shell 13 is connected.

In conclusion, the invention provides a cable end connector, which has the advantages as follows:

1. The cable end connector is assembled by: mounting the stop flange 21 of the core tube 2 in the coupling portion 11 of the tubular connection member 1 and coupling the front tubular coupling portion 31 of the plastic outer tubular member 3 to the coupling portion 11 of the tubular connection member 1 and then fastening the retaining sleeve 4 to the rear tubular body 33 of the plastic outer tubular member 3. This assembly process is quite simple, requiring less installation labor and time.
2. During application, the inner dielectric insulator 72 and aluminum foil shield 73 of the coaxial cable 7 are inserted into the receiving chamber 20 of the core tube 2 to force the center conductor 71 of the coaxial cable 7 into the metal clamp 622 in the rear center hole 620 of the metal center pin 62 in the insulative holder block 6, enabling the center conductor 71 to be clamped by the clamp pawls 623 of the metal clamp 622 and electrically connected to the metal center pin 62, at the same time, the barbed flange 23 of the core tube 2 is engaged into the braided metal wrapper 74 of the coaxial cable 7 and the shoulder 41 of the retaining sleeve 4 is pressed on the periphery of the outer plastic sheath 75 of the coaxial cable 7, and therefore, the braided metal wrapper 74 and outer plastic sheath 75 of the coaxial cable 7 are firmly secured in place inside the plastic outer tubular member 3 and the retaining sleeve 4 and between the plastic outer tubular member 3 and the core tube 2. Thus, the coaxial cable 7 and the cable end connector are tightly fastened together and electrically connected together, avoiding accidental disconnection.

As stated above, the cable end connector comprises a tubular connection member, a core tube mounted in the tubular connection member, a plastic outer tubular member axially slidably coupled to the tubular connection member around the core tube, a retaining sleeve fastened to the around the core tube and an insulative holder block mounted in the core tube to hold a metal center pin and a metal clamp in the rear center hole of the metal center pin. After connection of the cable end connector to a coaxial cable, the center conductor of the coaxial cable is secured firmly to the metal clamp in the metal center pin and electrically connected to the metal center pin for signal transmission to a mating electric connector to which the tubular connection member of the cable end connector is connected.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A cable end connector, comprising:

a tubular connection member, said tubular connection member comprising an axial hole defined therein and extending through opposing front and rear sides thereof and a coupling portion located on a rear side around the axial hole thereof;

an core tube, said core tube comprising a receiving chamber defined therein and extending through opposing front and rear sides thereof, a stop flange outwardly protruded from the periphery of the front side thereof and mounted in the coupling portion of said tubular connection member, a barbed flange located on the rear side thereof, a coupling portion spaced between said stop flange and said barbed flange;

a plastic outer tubular member, said plastic outer tubular member comprising a front tubular coupling portion coupled to the coupling portion of said tubular connection member, a rear tubular body, an accommodation chamber axially extending through said front tubular coupling portion and said rear tubular boy, and an annular packing portion inwardly protruded from an inside wall of said front tubular coupling portion and suspending in said accommodation chamber for engaging the coupling portion of said core tube; and a retaining sleeve fastened to the rear tubular body of said plastic outer tubular member, said retaining sleeve comprising a sleeve chamber defined therein for receiving said plastic outer tubular member, an insertion hole located on a rear side thereof in communication with said sleeve chamber and a shoulder protruded from an inside wall thereof adjacent to said insertion hole for stopping said plastic outer tubular member in place.

2. The cable end connector as claimed in claim 1, wherein said tubular connection member further comprises an annular retaining rim inwardly protruded from one end of the coupling portion thereof for engaging the stop flange of said core tube.

3. The cable end connector as claimed in claim 1, wherein said tubular connection member further comprises a connection portion located on the front side around the axial hole thereof for connection to an external mating electric connector.

4. The cable end connector as claimed in claim 1, wherein said tubular connection member further comprises a connection portion located on the front side around the axial hole thereof for connection to an external mating electric connector, a plurality of longitudinal crevices cut through said connection portion thereof, and a hollow sliding shell axially slidably coupled to said connection portion.

5. The cable end connector as claimed in claim 4, wherein said hollow sliding shell comprises a sliding hole axially forwardly extending to a front side thereof and adapted for receiving said connection portion of said tubular connection member, a receiving chamber axially backwardly extending from said sliding hole to a rear side thereof, and a locating groove extending around an inside wall thereof in said receiving chamber; tubular connection member further comprises a snap ring fixedly fastened to the periphery of said connection portion, an insulative washer mounted on said connection portion and stopped against a front side of said snap ring, a metal washer sleeved onto said connection portion and fastened to the locating groove of said hollow sliding shell for axial movement with said hollow sliding shell along said connection portion and an elastic member mounted around said connection portion and stopped between said snap ring and said metal washer.

6. The cable end connector as claimed in claim 1, further comprising a stop member mounted in the axial hole of said tubular connection member and stopped against the stop flange of said core tube, said stop member comprising an inside chamber defined therein, a through hole located on a front side in communication with said inside chamber, an opening located on a rear side thereof and kept in communication between said inside chamber and the receiving chamber of said core tube.

7. The cable end connector as claimed in claim 1, further comprising an insulative holder block mounted in the axial hole of said tubular connection member and a metal center pin fastened to said insulative holder block, said insulative holder block comprising a rear abutment face located on a rear side thereof and abutted against the stop flange of said core tube, a front mounting hole located on a front side thereof and a rear guide hole located on said rear abutment face in communication with said front mounting hole, said metal center pin comprising a rear mounting base press-fitted into the front mounting hole of said insulative holder block, a front pin head axially forwardly extended from said rear mounting base and suspending outside said insulative holder block, a rear center hole formed in said rear mounting base and axially extending to a rear side of said rear mounting base remote from said front pin head and a metal clamp mounted in said rear center hole, said metal clamp comprising a plurality of metal clamp pawls equiangularly spaced around the periphery of said rear center hole and obliquely forwardly extending in direction toward the central axis of said rear center hole.

8. The cable end connector as claimed in claim 1, further comprising an insulative holder block mounted in said receiving chamber of said core tube and a metal center pin fastened to said insulative holder block, said insulative holder block comprising a rear abutment face located on a rear side thereof and facing the insertion hole of said retaining sleeve, a front mounting hole located on a front side thereof and a rear guide hole located on said rear abutment face in communication with said front mounting hole, said metal center pin comprising a rear mounting base press-fitted into the front mounting hole of said insulative holder block, a front pin head axially forwardly extended from said rear mounting base and suspending outside said insulative holder block, a rear center hole formed in said rear mounting base and axially extending to a rear side of said rear mounting base remote from said front pin head and a metal clamp mounted in said rear center hole, said metal clamp comprising a plurality of metal clamp pawls equiangularly spaced around the periphery of said rear center hole and obliquely forwardly extending in direction toward the central axis of said rear center hole.

9. The cable end connector as claimed in claim 1, wherein the coupling portion of said core tube comprises a coupling groove and a coupling rib extending around the periphery thereof in a parallel manner and abutted against each other; the annular packing portion of said plastic outer tubular member comprises a packing rib suspending in said accommodation chamber and a beveled face located on one side of said packing rib, the coupling portion of said core tube having an outer diameter greater than the inner diameter of said annular packing portion of said plastic outer tubular member.

10. The cable end connector as claimed in claim 1, wherein the rear tubular body of said plastic outer tubular member has an outer diameter relatively smaller than said front tubular coupling portion and is fitted into the sleeve chamber of said retaining sleeve.

11. The cable end connector as claimed in claim 1, wherein the rear tubular body of said plastic outer tubular member has a rear end edge stopped against the shoulder of said retaining sleeve.

12. The cable end connector as claimed in claim 1, wherein the insertion hole of said retaining sleeve is a tapered hole having a diameter gradually reducing indirection toward the inside of said sleeve chamber.

* * * * *